United States Patent [19]

Henneberg et al.

[11] 4,381,714

[45] May 3, 1983

[54] CONTINUOUSLY ADJUSTABLE COMPUTER CONSOLE TABLE

[75] Inventors: Helmut H. Henneberg, Canton; Ralph H. Arabian, Andover; Howard A. Grant, Chelmsford, all of Mass.

[73] Assignee: Honeywell Information Systems Inc., Waltham, Mass.

[21] Appl. No.: 224,589

[22] Filed: Jan. 12, 1981

[51] Int. Cl.[3] ..... A47B 9/00

[52] U.S. Cl. ..... 108/147; 108/144; 108/146; 248/188.5; 312/312

[58] Field of Search ..... 108/144, 146, 147, 148; 312/312; 297/339, 347; 248/188.5, 188.2

[56] References Cited

U.S. PATENT DOCUMENTS

| | | | |
|---|---|---|---|
| 1,683,228 | 9/1928 | Armstrong | 108/96 |
| 2,649,137 | 8/1953 | Roberts | 108/146 |
| 3,140,559 | 7/1964 | Grow et al. | 108/147 X |
| 3,411,464 | 11/1968 | MacKay | 108/144 X |
| 3,444,830 | 5/1969 | Doetsch | 108/2 X |
| 3,595,180 | 2/1969 | Swoyer | 108/144 |
| 3,687,088 | 8/1972 | Hasbrouck | 108/148 |
| 3,711,054 | 6/1970 | Bauer | 297/345 X |
| 3,825,244 | 7/1974 | Bauer | 108/144 X |
| 3,837,704 | 9/1974 | Bauer | 297/345 |
| 3,966,182 | 6/1976 | Stadelmann et al. | 248/400 X |
| 4,099,469 | 7/1978 | Sahli | 108/1 |
| 4,108,416 | 8/1978 | Nagase et al. | 248/400 |

FOREIGN PATENT DOCUMENTS

| | | | |
|---|---|---|---|
| 59012 | 8/1941 | Denmark | 108/147 |

*Primary Examiner*—James T. McCall

*Attorney, Agent, or Firm*—William A. Linnell; Nicholas Prasinos

[57] ABSTRACT

An article of furniture used to support a computer terminal or a similar object having means to continuously adjust in a stepless fashion the table top height through the operation of a single operating lever located just beneath the table top which can be operated from a seated or standing position. Swinging the operating lever in one direction in the horizontal plane releases an adjustable length gas spring controlling table top height, allowing for the raising or lowering of the table top which is followed by the return of the operating lever to its original position which locks gas spring at its new length and rigidly locks the table top at its adjusted height.

11 Claims, 3 Drawing Figures

CONTINUOUSLY ADJUSTABLE COMPUTER CONSOLE TABLE

BACKGROUND OF THE INVENTION

1. Field of the Invention

The invention relates to an article of furniture, more particularly to a table, with a table top height continuously adjustable in a stepless fashion to the particular body dimensions of the user.

While the invention has particular application for supporting computer consoles or terminals of data processing systems and will be described hereinafter for such use, it is to be understood that the present invention may be utilized as a table to support or hold other articles.

2. Description of the Prior Art

The construction of computer consoles used to support a computer terminal such as a typewriter-like device or a cathode ray tube having a data entry keyboard as used in offices, factories or the like, is based on the recognition that the best possible efficiency of a worker is only achieved if the operator can suitably assume a comfortable and anatomically correct seated or standing position at his work place. In a data processing environment, this means placing the keyboard at a comfortable height for data entry by the operator's hands as well as a comfortable height so that data can be easily read from an associated data display on the terminal. Also such correct working position contributes considerably to remaining in health. In order to be able to adapt the computer console to the body dimensions of the user, it is necessary to construct a table such that the table top adjustable in height in the vertical direction.

One method of adjusting the heights of a table is disclosed in U.S. Pat. No. 3,595,180 entitled "Adjustable Heights Device for Data Processing Equipment" issued to Vincent H. Swoyer which describes the placement of tubular extensions having a cross-section the same as each of the four supporting legs. As described in this patent, the extensions support the equipment at a height from which it can be operated easily by a person standing at the table, and when the extensions are removed by sliding them off all ends of the table legs, the table is then supported at its lower level from which it may be conveniently operated from a person at a seating position. Although this patent describes a method for adjusting the heights of a table which is intended for adjusting the heights of the word processing equipment or a table from that of a seating position to a standing position or vice versa, this same method could equally well be employed for adjusting the height to various seating positions or standing positions by providing a variety of extension supports of varying lengths such that the height of the table could be adjusted to the individual operator. However, this method has the great disadvantage that placement and removal of the extension supports requires that the total weight of the equipment be lifted from the floor while the extension supports are put in place or removed. It is therefore not practical to be employed to adjust the equipment to the most efficient heights for individual operators on a hourly or daily basis to compensate for the variety of individuals operating the equipment. Therefore, what is needed is a method by which the table height of data processing equipment may be rapidly and easily adjusted.

It is known to use the so-called gas spring in various pedestal-supported tables as a means of continuously adjusting the height of the table top in a stepless fashion. The gas spring is a pneumatic spring in which the compressing power and extension power is determined by: the gas-filling pressure, the piston rod surface, the friction and the ratio of the filling volume to gas volume with the piston rod in the compressed position. Among the various U.S. patents which disclose the use of a gas spring as a means for adjusting the height of a chair seat or table top are U.S. Pat. No. 3,711,054 entitled "Continuously Adjustable Lifting Devices" issued to Fritz Bauer, U.S. Pat. No. 3,825,244 entitled "Hydraulically Lockable Lifting Device" issued to Fritz Bauer, U.S. Pat. No. 3,837,704 entitled "Seating Furniture" issued to Fritz Bauer, and U.S. Pat. No. 4,108,416 entitled "Device for Adjusting Length of Gas Spring" issued to Toshiro Nagase and Sagamihara Susumu Hatakeyama. All of these U.S. patents disclose using a gas spring in a telescoping pedestal column which is extended or shortened to raise or lower the seat or table top. Tables constructed to use with pedestal columns appear to have problems in providing for the jam-free extension or shortening of the pedestal column as the height of the table is adjusted. This appears to be a particular problem when the load on the table is placed off-center to the pedestal column. Further, the off-center placement of a load on a table supported by a single pedestal column requires that the pedestal have a large foot section so that the table has lateral stability and will not tip over. In addition, if heavy loads are to be placed on a table, the table top surface itself may have to be braced along its perimeter and braced to the pedestal column top so that the table top will not be twisted or excessively flexed by large loads. Also, the placement of a pedestal column with a large cross-section in the center of the table may interfere with the legs of the operator seated at the table and prohibit the operator from assuming a comfortable position.

A computer console constructed in this manner is understandably expensive to manufacture since the possibility of table height adjustment necessarily adds structure and parts not found in computer consoles with fixed heights tables. If the table heights is readily adjustable by means of a one or more operating levers, it is usually necessary to distribute and arrange the operating levers in places on the table frame carrying the table top surface, most of these places being inaccessible by the user while in the operating position, be it seated or standing. Consequently, frequently the greatest part of the adjustment possibility is not explored at all. Apart from this, a large number of operating levers detracts from the shape and appearance of the computer console so that in spite of the existing requirement, the table heights in most computer consoles is at a fixed height in order to simplify and accordingly make more economical the manufacture of such computer consoles.

In U.S. Pat. No. 3,444,830 entitled "Adjustable Gas Spring Supported Drawing Table" issued to Hans Peter Doetsch describes a drawing table supported by a gas spring in which the raising and lowering of the drawing table can be accomplished by means of a single lever. For such height adjustments, the drawing board is provided near each vertically extended side thereof with a pair of arms which are pivotably connected to the drawing board and to the frame and together with the frame of the drawing board form a parallelogram. For locking the drawing board in a fixed position at any level to which it is adjusted, a locking means is provided at one of the pivot points, for example at the pivot point between the upper arm and the frame. To compensate for the weight of the drawing board at any level thereof, one end of gas spring is typically connected to the upper arm at a suitable distance from the pivot of the arm in the frame while the other end of the gas spring is typically connected to the base of the frame so that the entire gas spring extends in a substantially vertical direction. This drawing table offers numerous advantages over older known designs, but is still relatively complicated in its design; in particular, the construction of the arms with the pivots at the end thereof is relatively costly to manufacture. Further, the service of the drawing table extends primarily in the vertical plane and does not present a horizontal surface on which a computer terminal may be rested and would therefore require yet additional structure in order to provide a horizontal surface whose height is adjustable in the vertical direction.

OBJECTS OF THE INVENTION

Hence, it is an object of the present invention is to design a computer console of the kind such that the heights of the table top can be continuously adjusted in the vertical direction by use of a single operating lever while the operator is in the work position at the console, be it seated or standing, thus making this mechanism especially simple and easy to operate.

It is another object of the present invention to provide a table with a continuously height adjustment top surface in such a way, that with little expense as regards to materials, good stability is given for the stepless height adjustment and for the table as a whole.

It is yet another object of the present invention to provide a table that is simple in construction with an adjustable height top surface that can be rapidly adjusted with little effort.

SUMMARY OF THE INVENTION

Consequently, the present invention relates to an article of furniture such as a computer console with a gas spring incorporated in the base for continuous vertical height adjustment in a stepless fashion of the table top having a single operating lever mounted beneath the table top at the upper end of gas spring, said lever being horizontally swivelable, wherein a movement of the lever in one direction acts to unlock the vertically mounted gas spring which supports the table top by being rotatably connected at its upper end to the underside of the table top and by being rigidly connected at the lower end by a bracket projecting from the back vertical surface of the computer console. The table top is slideably fastened to the table frame by a pair of laterally spaced vertically mounted slides which permit the table top to be displaced in the vertical direction. The slideable member of each of the slides is fastened to the table top and the fixed member is fastened to the table frame. The spring characteristics of gas spring are chosen such that when unlocked the upward compression force exerted by gas spring on the table top is greater than the weight of the table top and the associated computer terminal such that the table surface will slowly rise in the vertical direction. If the table top is to be lowered, the operator simply exerts a downward force on the table top such that the combined downward force applied by the operator and the weight of the table top and associated computer terminal is greater than the upward force exerted by gas spring. Once the table top has been positioned at the desired vertical height, the operator simply swivels the lever in the opposite direction to return it to the locked position thereby relocking the gas spring which then rigidly supports the table top.

This invention is pointed out with particularity in the appended claims. An understanding of the above and further objects and advantages of this invention may be obtained by referring to the following description taken in conjunction with the drawings.

BRIEF DESCRIPTION OF THE DRAWINGS

The manner in which the apparatus of the present invention is constructed and its mode of operation can best be understood in light of the following detailed description together with the accompanying drawings in which like reference numerals identify like elements in the several figures and in which.

DESCRIPTION OF THE PREFERRED EMBODIMENT

Figure 1:
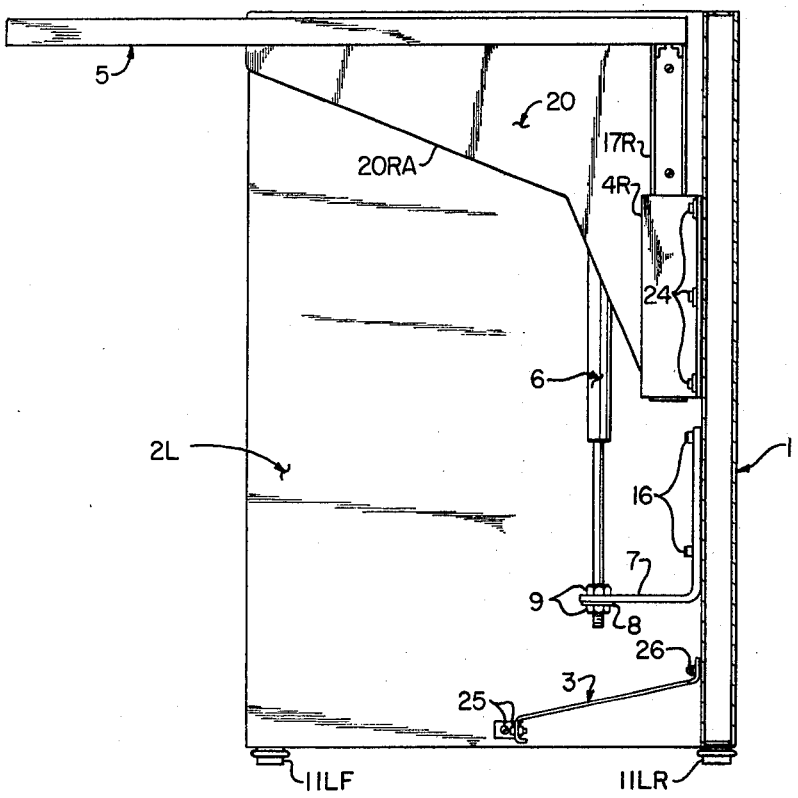
FIG. 1 is a vertical end cross section through the table of the present invention along line A—A in FIG. 2.

FIG. 1 shows a side view of a computer console table in which gas spring 6 is connected for counterbalancing and supporting the weight of table top 5 along with the computer terminal placed thereon (not illustrated in FIG. 1). Rear panel assembly 1 is supported in a vertical plane by a pair of side panel assemblies 2 projecting forward from the left and right edges of rear panel assembly 1. Left side panel assembly 2L is suitably fastened to the left edge of rear panel assembly 1 and similarly right panel assembly 2R is fastened to the right edge of rear panel assembly 1 (see FIG. 2). Lower spring bracket 7 is fastened to rear panel assembly 1 by screws with lock washers 16. The lower end of gas spring 6 is supported by lower spring bracket 7 and the upper end of gas spring 6 is held in place by upper spring bearing mount 19 which is secured to the underside of table top 5 by screws 21 (see FIG. 2).

Table top 5 is further supported by cantilever support 20 which when viewed from below is a U-shaped support comprised of left arm 20LA and right arm 20RA and back panel 20BP (see FIG. 3). The upper edge of cantilever support 20 is formed to have a flange running along the top of each arm 20RA and 20LA and back panel 20BP which is secured to the lower surface of table top 5 by screws 22 (see FIGS. 2 and 3). Cantilever support 20 is slideably mounted to the rear panel assembly 1 by a pair of ball bearing slide assemblies 17 and a pair of slide brackets 4. Ball bearing slide assemblies 17 provide for the up and down vertical displacement of table top 5 with little play and without any lateral on front-to-back tilting of the table top 5 under an off-center and placed load. The longer sliding member of the right ball bearing slide assembly 17R is fastened along the rear edge of the outer surface of right arm 20RA of cantilever support 20 and similarly the longer sliding member of left ball bearing slide assembly 17L is fastened to the left arm 20LA by screws, lock washers and nuts 23. The short fixed members of ball bearing slide assemblies 17 are fastened to slide brackets 4 by spot welding thus permitting the long sliding member of ball bearing slide assemblies 17 to be displaced vertically as a table is raised or lowered while the short fixed members are held securely in position by slide brackets 4. Slide brackets 4R and 4L are fixed securely to rear panel assembly 1 by screws and lock washers 24.

Each of the four corners of the console table assembly is supported by a leveling foot 11 which is threaded into the front and rear corners of side panel assemblies 2 such that the feet may be adjusted to compensate for uneven floor conditions. If leveling is not required and moveability of the computer console table is a factor, leveling feet 11 may be replaced by roller casters thus making the entire computer console table easily moveable. FIG. 1 illustrates the left front leveling foot 11LF and the left rear leveling foot 11LR. Side panel assemblies 2 are maintained parallel to each other and perpendicular to rear panel assembly 1 by foot rest assembly 3 which is fastened to side panel assemblies 2 by screws and lock washers 25 and to rear panel assembly 1 by screws and lock washers 26. In addition to providing structural rigidity of the side panel assemblies 2 with respect to rear panel assembly 1, foot rest 3 provides a place for the operator seated at the computer console table to rest his or her feet and provides a cable trough under which cables from the computer terminal situated on the computer console table or cables from other associated computer equipment can be run from side to side of the table and be protected from damage.

FIG. 1 illustrates that gas spring 6 is mounted vertically parallel to rear panel assembly 1 and parallel to ball bearing slide assemblies 17. Gas spring 6 is mounted vertically near the rear panel such that it does not interfere with the legs of the operator seated at the computer console table. In the preferred embodiment which has a table top front-to-back depth of 26 inches and which is used to support a computer terminal weighing approximately 50 pounds, gas spring 6 is mounted 6 inches from rear panel assembly 1 which places it approximately 4 inches forward of a vertical plane running through the center lines of ball bearing slide assemblies 17. The center lines of slide assemblies 17 are 2 inches forward of rear panel assembly 1. From FIG. 2 it can be appreciated that gas spring 6 is mounted in the middle of the table top 5 width such that gas spring may be easily accommodated if necessary between the legs of the operator seated at the computer console table. In the preferred embodiment, the 6 inch spring of the gas spring 6 from rear panel assembly 1 results in the gas spring 6 being 20 inches from the front edge of table top 5 and is comfortably away from the operator's knees. A top view of lower spring bracket 7 would also reveal that the horizontal projecting portion of the lower spring bracket 7 is more or less triangularly shaped such that the bracket offers minimum interference to the legs or feet of the operator.

Figure 2:
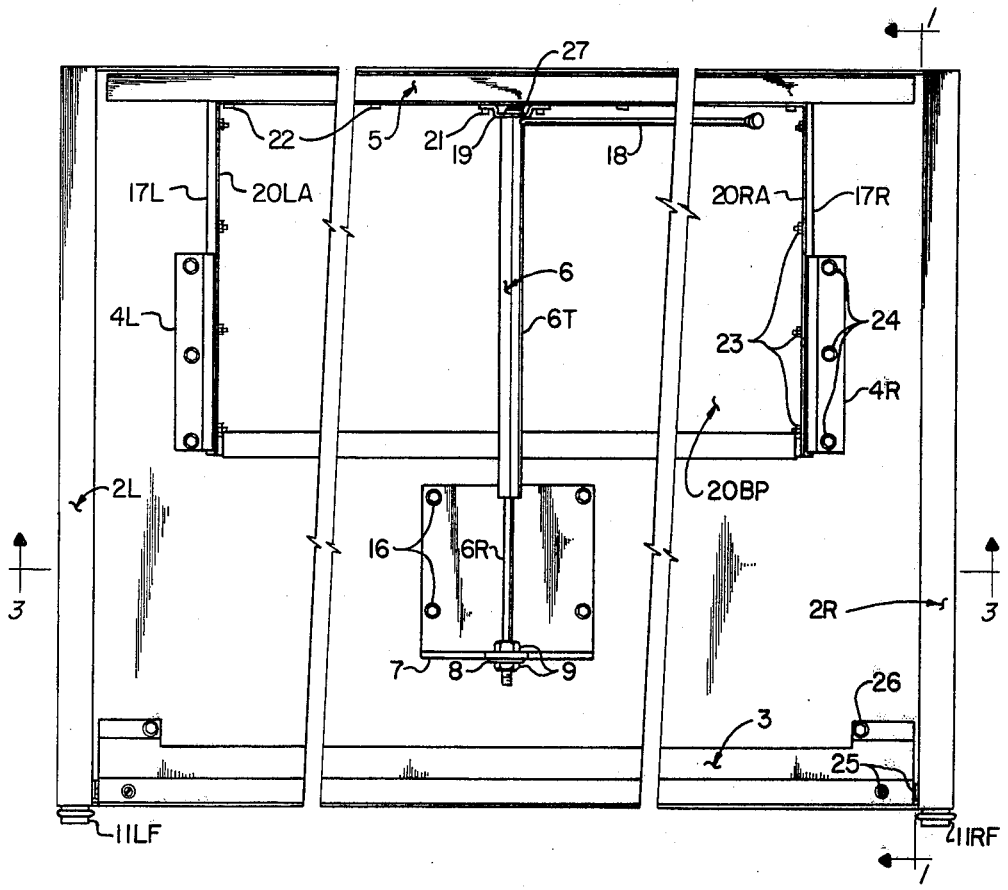
FIG. 2 is a vertical front view of the invention.

FIG. 2 illustrates that the distance between left arm 20LA and right arm 20RA of cantilever support 20 is such that the legs of the operator may comfortably fit between arms 20LA and 20RA without danger of the legs of the operator being struck by the arms when the table top 5 is lowered. This wide lateral spring of arms 20LA and 20RA of cantilever support 20 also contributes to the rigidity of table top 5 which might tend to twist and flex under a weight load not accurately centered on the table top. In addition, this wide spacing of arms 20LA and 20RA results in the wide spacing of slide assemblies 17 and contributes to the stability of table top 5 and to its jam-free vertical adjustability. In the preferred embodiment, table top 5 is 36 inches wide and the intended spacing between arms 20LA and 20RA is approximately 24 inches.

Figure 3:
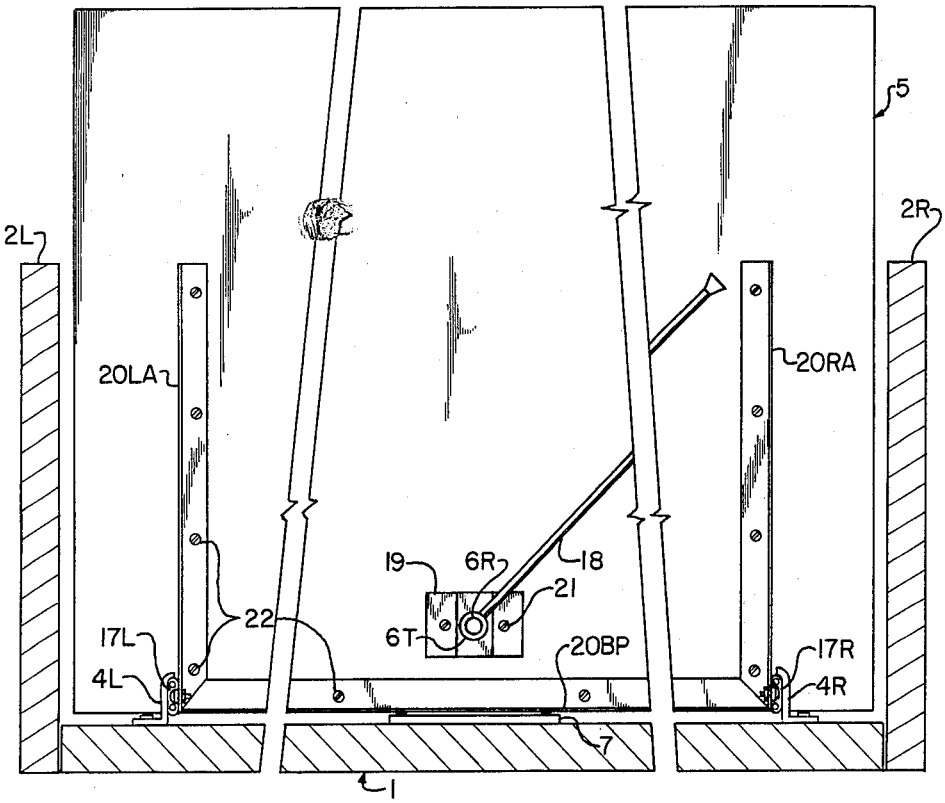
FIG. 3 is a horizontal bottom cross section through the table along line B—B in FIG. 2.

As can be appreciated by viewing FIGS. 1, 2 and 3, there is sufficient clearance between table top 5 and side panel assemblies 2 and rear panel assembly 1 such that the table top 5 may be raised and lowered vertically without striking or rubbing on the side panel assemblies 2 or rear panel assemly 1. In the preferred embodiment, this clearance between the table top and the supporting panels is approximately 0.75 inches which is also sufficient to allow most cables running to a computer terminal placed on the table to pass between the table top and the panels and be fed into the table trough provided by the foot rest 3. Alternately, a hole for cable fed through can be provided in table top 5. This 0.75 inch clearance between the rear edge of table top 5 and rear panel assembly 1 also ensures that the back panel 20BP which is mounted along the rear edge of table top 5 will clear heads of screws 16 and lower spring bracket 7 whether the table top is adjusted to the extreme low position.

Referring to FIG. 2, the mounting of lockable gas spring 6 will now be discussed in greater detail. Gas spring 6 is comprised of outer tube 6T and piston rod 6R. Outer tube 6T is filled with a compressed gas which exerts force on piston rod 6R which emerges from one end of gas spring 6 in a sealed manner. Outer tube 6T is provided with stops which prevent piston rod 6R from being expelled from the outer tube 6T. The pressure of the (compressed gas in gas spring 6 is made sufficiently high such that the expulsion force is greater than the weight of: table top 5, cantilever support 20, ball bearing slide assemblies 17, and the computer terminal to be supported on the table. This expulsion force is equal to the product of the gas pressure and the free piston ring surface of piston rod 6R and is achieved at every position of the piston rod in the outer tube 6T. In the preferred embodiment, the weight of the table top assembly is approximately 22 pounds and the weight of the computer terminal is approximately 50 pounds giving a combined weight of 72 pounds and the force of gas spring has been chosen to be 75 pounds such that when gas spring 6 is unlocked the table top will tend to slowly rise and the operator by exerting the force of approximately 5 (depending on the weight of the terminal) pounds may lower the table top and then relock the gas spring. In actual practice, as long as the extension force of the gas spring is from 0 to 20 pounds greater than the combined weight of the table top assembly and the terminal, it has been found that the table top 5 can be raised and lowered comfortably by an operator. This 0 to 20 pound force range provides for the table manufactured with a gas spring having a fixed extension force to be used to support a wide range of terminals as long as the weight of the heaviest terminal is no more than 20 pounds greater than that of the lightest terminal.

In the preferred embodiment, gas spring 6 is of the Sax-O-Lift gas spring manufactured by Stabilus GMBH of D5400 Koblenz, Germany. The Sax-O-Lift gas spring is a locking gas spring which may be locked in any extended position. The length adjustment in the Sax-O-Lift gas spring valve is controlled by rotation of the outer tube 6T relative to piston rod 6R. Closing the locking valve prevents the compressed gas in the spring from flowing through a piston by-passage and thereby locks the extension of piston rod 6R relative to outer tube 6T thereby determining the adjusted length of gas spring 6. The locking of the Sax-O-Lift gas spring is rigid. The particular version of the Sax-O-Lift gas spring used in the preferred embodiment is without separating pistons and therefore must be mounted with piston rod 6T extending downwards as illustrated in FIGS. 1 and 2. Further, gas spring 6 is dampened on extension such that the dampening action tends to reduce the rate at which the table top rises and thereby prevents the table surface from rapidly rising when gas spring 6 is unlocked and no terminal is on the table top.

To provide for the rotation of outer tube 6T relative to piston rod 6R, the lower end of piston rod 6R which is fastened to lower spring bracket 7 by threaded nuts 9 and lock washer 8. The upper end of gas spring 6 is rotatively fastened to the underside of table top 5 by upper spring bearing mount 19 which is fastened to table top 5 by screws 21. The upper end of outer tube 6T comprises a circular stud which projects through a suitable size circular hole in upper spring bearing mount 19. Upper spring bearing mount 19 acts as a thrust bearing which rests on a shoulder formed between the stud and the main body of outer tube 6T. Upper spring bearing mount 19 bears the total weight of the table top and any computer terminal or other article situated thereon. The upper end of gas spring 6 is secured in upper spring bearing mount 19 by a washer and C-spring ring 27 engaged in an annular groove in the stud on top of outer tube 6T which projects into the space between upper spring bearing mount 19 and the underside of table top 5. This annular groove in the stud is provided at a spacing from the shoulder of outer tube 6T which corresponds to the thickness of upper spring bearing mount 19 and the washer. Thus outer tube 6T is axially non-displaceable with respect to table top 5 but nevertheless rotatable with respect to piston rod 6R and table top 5.

When viewed from below as in FIG. 3, the counter-clockwise rotation of locking lever 18 which is screwed into outer tube 6T results in the rotation of outer tube 6T relative to piston rods 6R thereby operating the valve of gas spring 6 and unlocking gas spring for length adjustment. In the preferred embodiment, a swing of locking lever 18 through 90 degrees is required to go from a closed valve (locked) position to a fully open (adjustable) position. Once the table top 5 has been adjusted to the desired height, locking lever 18 is rotated in the clockwise direction to the original position and the gas spring is locked at its current extension, thereby fixing the height of table top 5. As can be appreciated by viewing FIGS. 2 and 3, locking lever 18 is situated sufficiently near the underside of table top 5 so that it does not interfere with the legs of an operator and the length of locking lever 18 is sufficiently long so that it is conveniently accessable and therefore easily and comfortably operated from a seated or standing position.

From FIG. 2 it can be appreciated that the downward movement of the table top 5 is limited by either: internal stops in gas spring 6, the lower end of outer tube 6T striking the upper surface of nuts 9, the lower surface of table top 5 striking the upper surface of slide brackets 4, or as in the case of the preferred embodiment, by stops built into ball bearing slide assemblies 17. Cushions could be added if desired at one or more of these points, but they have not been found to be necessary in the preferred embodiment. FIG. 2 which shows the table top 5 raised to its maximum height illustrates that the upward movement of the table top is limited by either a stop built into gas spring 6 which prohibits the further movement of outer tube 6T with respect to piston rod 6R or, again as in the case of the preferred embodiment, by stops built into the ends of ball bearing slide assemblies 17. Again cushions could be provided if desired.

In the preferred embodiment, the major structural components of the computer console table with the exception of table top 5 are constructed of formed sheet metal and table top 5 is constructed of wood particle board covered with plastic laminate although other similar materials can be used.

FIGS. 1, 2 and 3 illustrate a free-standing computer console table which is designed to support a computer terminal to be operated from a seated position. In the preferred embodiment, the heights of the rear panel assembly 1 and side panel assemblies 2 are approximately 30 inches and the top surface of table top 5 can be adjusted to be from a minimum height of 24 inches above the floor to a maximum height of 30 inches above the floor thus providing 6 inches of travel for the table top. This height adjustment of from 24 to 30 inches is sufficient to allow the majority of operators to operate a computer terminal in a most comfortable and productive position. If the computer terminal is to be operated from a standing position, the heights of the rear panel assembly 1 and side panel assemblies 2 can be raised and the maximum 6 inch height adjustment increased by providing longer ball bearing slide assemblies 17 and a gas spring 6 to provide for a 1 foot height adjustment which will more fully compensate for the larger difference in standing operating positions required for various heights of operators.

Although the computer console table has been illustrated in the figures as having rear panel assembly 1 supported by end panel assemblies 2, in some configurations of the preferred embodiment one or both end panels 2 are replaced by computer cabinets to which rear panel assembly 1 is fastened. Other versions of the computer console table are envisioned in which a short fixed member of ball bearing slide assemblies 17 is fastened to side panel assemblies 2 or computer cabinets instead of to rear panel assembly 1. Other variations are envisioned in which the rear panel assembly 1 and side panel assemblies 2 and foot rest 3 are eliminated entirely and the console table is mounted on a wall by securing slide brackets 4 and lower spring bracket 7 directly to a wall. A feature of all these variations is that the table can be constructed to be easily disassembled for shipment.

While the invention has been described in terms of a computer console for supporting data processing terminals, it is understood that the present invention may be utilized to support or hold other articles. While the table top surface has been described as being horizontal, it is envisioned that a slanted (e.g., from side-to-side or front-to-back) table top could be used or it could be made tiltable by using a pair of lockable pivot points on the cantilever support arms. Further, other types of lockable gas springs could be substituted with their locking levers suitably positioned to be easily accessable and yet not interfere with the operator seated at the table.

While the invention has been shown and described with reference to the preferred embodiment thereof, it will be understood by those skilled in the art that the above and other changes in form and detail may be made therein without departing from the spirit and scope of the invention.

What is claimed is:

1. A table having a continuously adjustable table top comprising:

A. a table top;

B. a frame;

C. a lockable gas spring;

D. a pair slides, each slide of said pair of slides having a long slideable member and a fixed member;

E. a cantilevered support rigidly fastened to said table top, said cantilevered support being a U-shaped member comprising:

1. a left arm;

2. a back panel; and 3. a right arm; said back panel having a length less than but approximately equal to the width of said table top, and wherein said long slideable member of a first of said pair of slides is fastened vertically to the rear edge of said left arm and said long slideable member of a second of said pair of slides is fastened vertically to the rear edge of said right arm and wherein each of said fixed members of said pair of slides is fastened vertically to said frame;

F. a lower spring bracket fastened to said frame and to a lower end of said lockable gas spring, said lower spring bracket for supporting said lockable gas spring, said cantilevered support, said table top and any article placed on said table top;

G. an upper spring bracket fastened to the underside of said table top and to an upper end of said lockable gas spring, said upper spring bracket for bearing the upward force of said lockable gas spring against the underside of said table top, and wherein said lower spring bracket is fastened to said frame approximately midway the lateral distance between said fixed members of said pair of slides and wherein said upper spring bracket is fastened to the underside of said table top approximately midway the lateral distance between said long slideable members of said pair of slides thereby aligning said lockable gas spring vertically in a plane perpendicular to said back panel; and H. an unlocking means connected to said lockable gas spring, said unlocking means for controlling the length of said lockable gas spring when displaced to a first position allowing the lengthwise adjustment of said lockable gas spring and when displaced to a second position locking said lockable gas spring at its adjusted length.

2. A table as in claim 1 wherein said frame is a vertical wall.

3. A table as in claim 1 wherein said frame comprises:

A. a rear panel assembly; and

B. a pair of side panel assemblies, each side of said pair of side panel assemblies connected to one end of said rear panel assembly such that rear panel assembly is supported in a vertical plane with said pair of side panel assemblies extending forward perpendicular to said rear panel assembly, a first side of said pair of side panel assemblies being parallel to a second side of said pair of side panel assemblies and wherein said lower spring bracket is fastened to said rear panel assembly.

4. A table as in claim 3 wherein said fixed members are fastened to said rear panel assembly.

5. A table as in claim 3 wherein a first of said fixed members is fastened to said first side and wherein a second of said fixed members is fastened to said second side.

6. A table as in claim 2 wherein said upper spring bracket is mounted on the underside of said table top at a distance from a rear edge of said table top such that said upper end of said lockable gas spring will be at a distance from said rear edge of said table top such that it is forward of a vertical center line of said long slideable members of said pair of slides.

7. A table as in claim 6 wherein said lower end of said lockable gas spring is fastened to said lower spring bracket at a distance from said rear panel assembly such that said lockable gas spring will be aligned vertically in a plane parallel to side rear panel assembly.

8. The table as in claim 7 wherein said lockable gas spring comprises an outer tube and a piston rod and said lockable gas spring is unlocked by rotating said outer tube relative to said piston rod and wherein said locking means comprises a lever at the upper end of said outer tube extending perpendicular to said outer tube and a valve activated by the rotation of said outer tube relative to said piston rod, the lower end of said piston rod being fixed to said lower spring bracket thereby preventing the rotation or axial displacement of said piston rod relative to said lower spring bracket, the upper end of said outer tube being fastened to said upper spring bracket in a manner that permits the rotation of said outer tube relative to said upper spring bracket but inhibits the axial displacement of said outer tube relative to said upper spring bracket.

9. The table of claim 8 wherein extension force of said lockable gas spring is slightly greater than the combined weight of that portion of said table which is displaced in the vertical direction when the height is adjusted and the weight of an article to be supported by said table, thereby allowing said lockable gas spring to counterbalance the displacement weight and permitting the table top to raise when said lockable gas spring is unlocked and yet permitting an operator to lower said table top by pressing downward thereon.

10. The table as in claim 9 wherein said lockable gas spring is damped on extension.

11. A table as in claim 1 wherein said pair of slides is a pair of ball bearing slides.

* * * * *